US005927134A

United States Patent [19]

Kutschker

[11] Patent Number: 5,927,134

[45] Date of Patent: Jul. 27, 1999

[54] BENDING MACHINE

[75] Inventor: Wolfgang Kutschker, Boeblingen, Germany

[73] Assignee: Reinhardt Maschinenbau GmbH, Sindelfingen, Germany

[21] Appl. No.: 09/065,789

[22] Filed: Apr. 23, 1998

Related U.S. Application Data

[63] Continuation of application No. PCT/EP97/04186, Aug. 1, 1997.

[30] Foreign Application Priority Data

Aug. 30, 1996 [DE] Germany ..... 196 35 106

[51] Int. Cl.[6] ..... B21D 5/04

[52] U.S. Cl. ..... 72/319

[58] Field of Search ..... 72/319–323, 306, 72/481.1, 482.1, 482.6, 478, 413

[56] References Cited

U.S. PATENT DOCUMENTS

| | | | |
|---|---|---|---|
| 4,660,402 | 4/1987 | Hongo | 72/319 |
| 4,722,214 | 2/1988 | Hayashi | 72/319 |
| 5,313,814 | 5/1994 | Yamamoto et al. | 72/319 |

FOREIGN PATENT DOCUMENTS

| | | | |
|---|---|---|---|
| 148021 | 9/1983 | Japan | 72/319 |
| 212446 | 8/1993 | Japan | 72/478 |
| WO 96/13346 | 5/1996 | WIPO . | |

OTHER PUBLICATIONS

*Patent Abstracts of Japan*, Abstract of Japanese Patent, "Bending Machine For Plate Material", Published Dec. 15, 1992 as Application No. 03162258, vol. 17, No. 233, May 12, 1993.

*Primary Examiner*—Daniel C. Crane
*Attorney, Agent, or Firm*—Barry R. Lipsitz; Ralph F. Hoppin

[57] ABSTRACT

In order to improve a bending machine comprising a bending beam, a first and a second clamping beam for clamping a workpiece, one of which has clamping tool segments arranged so as to be interchangeable, wherein at least one clamping tool segment with a movable base has a base part mounted on an upper part and movable relative thereto from a clamping position into an insertion position and vice versa, in such a manner that such a clamping tool segment with a movable base can be handled more easily it is suggested that a drive means free from supply lines for the movement of the base part be arranged in the upper part of the clamping tool segment with a movable base, that the drive means have an energy-receiving element for supplying drive energy to an activating device arranged on the bending machine during contact with an energy input element.

22 Claims, 7 Drawing Sheets

BENDING MACHINE

The present disclosure is a continuation of International Application No. PCT/EP97/04186 of Aug. 1, 1997, the entire specification of which is incorporated herein by reference.

BACKGROUND OF THE INVENTION

The invention relates to a bending machine, comprising a bending beam, a first and a second clamping beam for clamping a workpiece, one of them having clamping tool elements arranged so as to be interchangeable, wherein at least one clamping tool segment with a movable base has a base part mounted on an upper part and movable relative thereto from a clamping position into an insertion position and vice versa.

Bending machines of this type are known from the state of the art. With these, it is, for example, provided for the clamping tool segment with a movable base to have a hydraulic drive means, and thus be constantly connected to hydraulic lines which are always a hindrance during insertion of the segment into the upper beam or during removal of it from the upper beam.

SUMMARY OF THE INVENTION

The object underlying the invention is therefore to improve a bending machine of the generic type such that such a clamping tool segment with a movable base can be handled more easily.

This object is accomplished in accordance with the invention, in a bending machine of the type described at the outset, in that a drive means free from supply lines for the movement of the base part is arranged in the upper part of the clamping tool segment with a movable base, that the drive means has an energy-receiving element, by means of which drive energy can be supplied to the drive means during contact with an energy input element of an activating device arranged on the bending machine.

The great advantage of the inventive solution is to be seen in the fact that the drive means need not be constantly connected to lines but that the mere contact between the energy-receiving element and the energy input element is sufficient to supply the drive means with the necessary energy, wherein the activating device is arranged on the bending machine itself and thus remains on it so that the clamping tool segment with the movable base is easy to handle even after removal from the bending machine.

A particularly preferred solution provides for the energy input element to extend over a positioning area of the clamping tool segment with a movable base and for the drive energy to be transferred from the energy input element to the energy-receiving element in any optional position of the two relative to one another when the clamping tool segment with a movable base is arranged within the positioning area.

The advantage of this solution is to be seen in the fact that no defined positioning whatsoever of the clamping tool segment with a movable base, for example, within a grid need be maintained for the transfer of the drive energy but that the transfer of drive energy can be brought about in any optional relative position of the energy-receiving element in relation to the energy input element.

In principle, it would be possible to provide the entire width extension of the respective clamping beam as positioning area for a clamping tool segment with a movable base. This does, however, have the disadvantage that the insertion of a manipulator handling workpieces, preferably in the region of a center of the respective clamping beam, is hindered.

For this reason, a particularly advantageous embodiment of the inventive solution provides for the clamping beam to have a positioning area for one of the clamping tool segments with a movable base in respectively opposite outer regions.

In order to create the possibility of being able to transfer drive energy to the energy-receiving element by means of the energy input element, a particularly simple and inexpensive solution provides for the energy input element to extend over the positioning area along the respective clamping beam. This means that the possibility is created in a simple manner of reaching an energy-receiving element of a clamping tool segment with a movable base, which is arranged within the positioning area, with the energy input element.

The energy input element could, in principle, be mounted independently of the movability of the respective clamping beam, particularly with the entire activating device. It is, however, particularly favorable when the energy input element is movable with the respective clamping beam relative to the other clamping beam. This creates a particularly simple and, in particular, space-saving constructional solution for the arrangement of the energy input element.

In order to be able to provide the contact for transferring the drive energy, it is preferably provided for the energy input element to be movable relative to the respective clamping beam in the direction towards the energy-receiving element of the clamping tool segment with a movable base. Thus, the contact between the energy input element and the energy-receiving element can be provided in a particularly simple manner.

In principle it would be possible, for example, to construct the energy input element as an electrical contact bar and to transfer electrical energy to the drive means by way of contact with the energy-receiving element.

A solution which has a particularly simple construction and is also inexpensive provides, however, for mechanical energy to be transferable to the energy-receiving element with the energy input element since the transfer of mechanical energy, in particular, offers constructional advantages in comparison with the transfer of electrical energy in the case of a machine tool of this type which becomes apparent, for example, when considering safety aspects.

The transfer of the drive energy between the energy input element and the energy-receiving element in a mechanical manner could take place in the most varied of ways. For example, it would be conceivable to transfer the energy by way of a rotary movement or a traction movement.

A particularly advantageous embodiment provides for the energy input element to transfer the drive energy to the energy-receiving element by way of pressure on this.

Within the scope of the embodiments described thus far, no details have been given as to the extent, to which the transfer of the drive energy to the drive means of the clamping tool segment with a movable base is connected to other functions of the bending machine.

For example, it would be conceivable to provide an adjusting drive which can be controlled by a control as required and independently of the remaining functions of the bending machine.

A particularly advantageous solution of the inventive bending machine does, however, provide for the energy input element to actuate the energy-receiving element synchronously to the closure movement of the clamping beams. This solution has the advantage that the movement of the base part can be synchronized relative to the closure movement of the clamping beams with a suitable design of the drive means. The movement of the base part from the insertion position into the clamping position can—particularly in coordination with the dimensions of the sheet-metal part to be bent—be synchronized with the closure of the clamping beams and thus the clamping of the sheet-metal part so that it is possible, for example, to reach the clamping position just shortly prior to a direct clamping of the sheet-metal part so that the base part is in a position to also engage in folds of a small magnitude.

This synchronous actuation of the energy-receiving element via the energy input element can also be achieved by means of a suitable control of an adjusting drive in synchronization with the closure movement of the clamping beams.

A particularly simple and reliable solution does, however, provide for the energy input element to be actuatable by means of an actuating lever which detects any relative movement of the clamping beams. This means that in this case the relative movement of the clamping beams may be mechanically detected directly by the actuating lever and the energy input element then actuated synchronously via this actuating lever so that no complicated control whatsoever is necessary but a direct conversion of the relative movement of the clamping beams, which takes place in any case with considerable force, for the actuation of the energy input element can take place.

In conjunction with the preceding description of the individual embodiments, attention has been focused on moving the base part as a function of the movement of the clamping beams, preferably synchronously to them, i.e. to carry out a movement of the base part with every clamping of a workpiece.

Since, however, a movement of the base part of the clamping tool segment with a movable base is not necessary at all in the inventive bending machine for a plurality of bending procedures, since the workpiece or sheet-metal part to be clamped has, in this region, no shape which can be engaged only prior to the closure of the clamping beams, a particularly expedient solution of an inventive bending machine provides for an adjusting drive to be associated with the energy input element, the energy input element actuating the energy-receiving means with this adjusting drive in such a manner that the base part constantly remains in its clamping position. This means that the possibility is created with such a solution of not moving the base part with each clamping of the workpiece but of keeping the base part constantly in its clamping position by means of the adjusting drive and, merely in those cases, in which it is absolutely necessary to move the base part from the clamping position into the single position, also carrying out this movement.

With respect to the design of the drive means itself, no details have been given in conjunction with the preceding explanations concerning the individual embodiments. A particularly expedient solution provides, for example, for the drive means of the base part to move this away from the upper part into a position extending under the base part of the next clamping tool segment in order to reach the insertion position. In this insertion position the base part preferably no longer protrudes laterally beyond an outer side of the upper part so that insertion is possible into a sheet-metal part, the shape of which requires engagement under an edge region, for example, a double fold at the edge or to the side.

A particularly favorable solution provides for the drive means to move the base part along a helical path away from the upper part as far as the insertion position. Such a helical path offers the advantage that it opens up the possibility of guiding the base part in a narrow space in a defined manner and, in addition, of designing the drive means in a space-saving and simple manner.

In this respect, it is preferably provided for the base part in the insertion position to be pivoted through 90° in comparison with the clamping position.

Since the mere provision of a helical path would, for example, entail the risk of the base part colliding with the base part of the next clamping tool segment, it is preferably provided for the drive means, proceeding from the clamping position, to move the base part linearly away from the upper part prior to its movement along the helical path. As a result, the base part can, first of all, be moved out of the clamping position without any collision due to the linear movement. Subsequently, either the inventive, helical movement can take place or, however, a different linear movement leading, for example, at an angle towards the side.

The realization of the inventive movements of the base part during the transition from the clamping position to the insertion position and vice versa is possible in a particularly simple manner when the drive means comprises a connecting guide link which defines a path of movement of the base part between the clamping position and the insertion position.

The connecting link guide in conjunction with the inventive drive means may be used in a constructionally simple manner particularly when this acts on a shaft bearing the base part and thus transfers the forms of movement defined by it directly to the base part.

In order to be able to realize the forms of movement of the base part in a particularly favorable manner with such a connecting link guide, an advantageous solution provides for an actuation of the energy-receiving element of the drive means to lead to an axial displacement of the shaft which then generates the desired forms of movement for the base part again in conjunction with the connecting link guide. This creates a solution for the drive means which is easy to realize, particularly mechanically.

In order not to have to realize paths of movement which are all too large during the transfer of the drive energy to the drive means, it is advantageously provided for the energy-receiving element to act on the shaft via a transmission mechanism and thus the shaft is displaced over a greater distance than the actuation of the energy-receiving element.

In conjunction with the preceding description of the clamping position, it has merely been specified that this can be reached and thus also defined as a result of the drive means.

Since, however, large forces and thus, where applicable, large torque can also act on the base part in the inventive solution, a particularly favorable solution provides for form-locking elements which engage in one another in the clamping position and non-rotatably fix the base part to be connected to the upper part and to the base part. These form-locking elements absorb forces to be transferred from the base part to the upper part and make it possible for these forces not to be introduced into the drive means so that this can be constructed in a correspondingly simple and, thus, inexpensive manner.

In this respect it is particularly favorable when the form-locking elements include a conical fit, wherein the inventive form of movement of the base part, which provides first of all for a linear movement, proceeding from the clamping position, and only subsequent thereto a helical movement, favors the provision of form-locking elements engaging in one another and, in particular, engaging in one another so as to fit, and wherein the conical shape simplifies the design of the guide means for the base part up to reaching the clamping position since a conical fit will always engage even with insufficient initial positioning.

Additional features and advantages of the inventive solution are the subject matter of the following description as well as the drawings illustrating several embodiments.

DETAILED DESCRIPTION OF INVENTION

Figure 1:
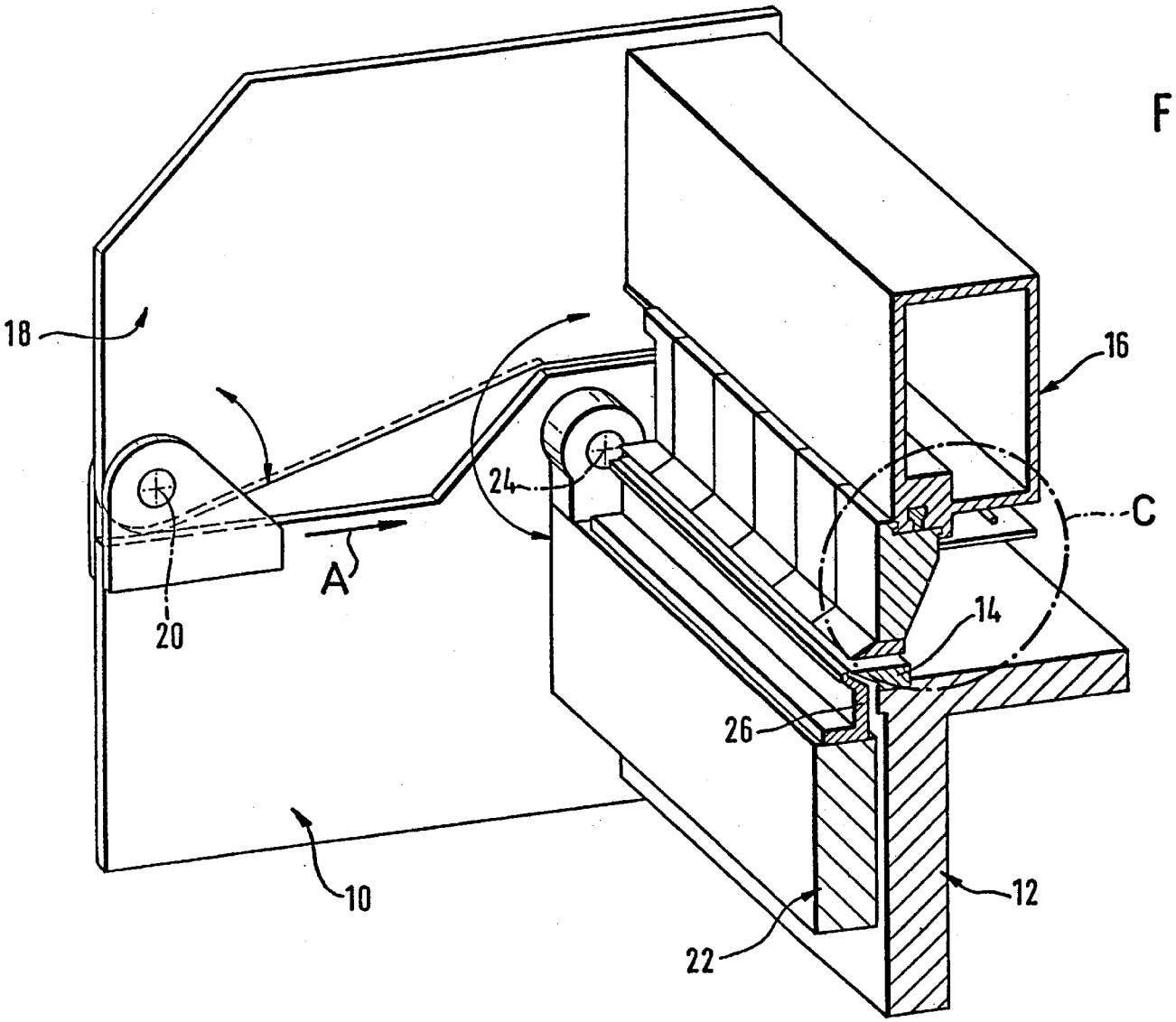
FIG. 1 shows a perspective, vertically cut side view of an inventive bending machine.

One embodiment of an inventive bending machine, illustrated in FIG. 1, comprises a lower frame 10, with which a lower beam 12 forming a clamping beam is rigidly connected. The lower beam 12 thereby bears a clamping tool 14 which is rigidly connected to it and extends over the entire width of the lower beam 12.

A second clamping beam is formed by an upper bean which is designated as a whole as 16, extends parallel to the lower beam 12 and is mounted on a rocker arm 18 which is rotatable for its part about an axis of rotation 20 relative to the lower frame 10. The rocker arm 18 is driven via a drive for the two clamping beams which is customary in bending machines.

In addition, a bending beam 22 is also held on the lower frame 10 so as to be, for example, pivotable about a pivot axis 24 so that a sheet-metal part clamped between the clamping beams 12 and 16 can be bent with a bending tool 26 of the bending beam.

In contrast to the clamping tool 14 which extends continuously over the entire width of the lower beam, clamping tool segments 30 and 32 are provided on the upper beam 16 (FIG. 2) which are mounted on the upper beam 16 so as to be interchangeable and thus open up the possibility of assembling a clamping tool 34 on the upper beam 16 to match a sheet-metal part 36 to be bent, wherein the clamping tool segments 30 and 32 are assembled in such a manner that base parts 40 and 42, respectively, thereof extend over the entire width B of the sheet-metal part 36 which is to be fixed in position and are thus able to clamp this over the entire width.

The clamping tool segments 30 form center pieces which can have a constant or a variable width and each have a base part 40 rigidly connected to an upper part 44.

Figure 2:
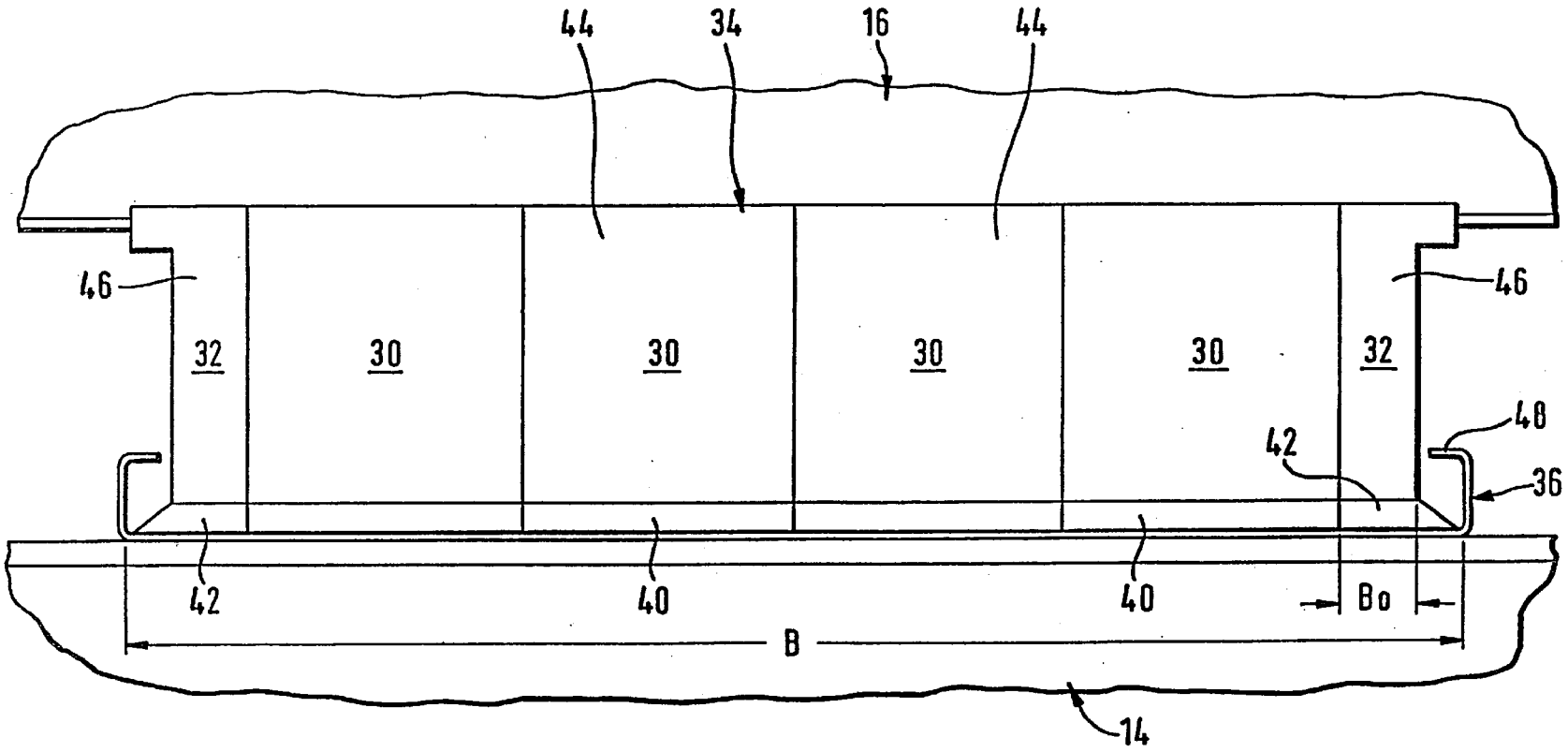
FIG. 2 shows a front view of the bending machine in the direction of arrow A in FIG. 1.

The clamping tool segments 32 form corner pieces, the upper parts 46 of which have a smaller width than the base parts 42 so that the base parts 42 project laterally beyond the upper parts 46 and are in a position to engage in an edge region 48 of the sheet-metal part 36 which has been bent twice, as illustrated in FIG. 2.

Since the upper beam 16 is lowered in the direct-on of the lower beam in order to clamp the sheet-metal part 36, the base parts 42 protruding laterally beyond the upper parts 46 would collide with the edge region 48 which has been bent twice. For this reason, the base parts 42 are, as illustrated for clarification in FIGS. 3 and 4, pivotable about a movement axis 50 and movable in longitudinal direction 52 thereof so that, as illustrated in FIG. 3, the base part 42 can be brought from an insertion position, in which it engages with a front region 54 under the base part 40 of the next, adjacent clamping tool segment 30 while a side region 56 thereof points in the same direction as a front region 58 of the next base part 40, under which it engages, into a clamping position drawn in FIG. 3 as a dashed line and in FIG. 4 as a solid line, in which the front region 54 of the base part 42 extends parallel to the front region 58 of the next base part 40 and the side region 56 engages in the edge region 48 of the sheet-metal part 36 and thereby protrudes laterally beyond the upper part 46 of the clamping tool segment 32.

In order to be able to carry out a combined pivoting and displacing movement about the movement axis 50 and in longitudinal direction 52 thereof with the base part 42, the base part 42 is rigidly connected to a shaft which extends coaxially to the movement axis 50 and is, for its part, guided and mounted in a corresponding shaft channel 62 in the upper part 46. This shaft 60 has a connecting guide link 64 in the shape of a groove worked into it, into which a connecting link follower 66 rigidly mounted on the upper part 46 engages. The connecting guide link 64 comprises, on the one hand, a helically extending section 68 and a straight section 70 which extends parallel to the movement axis 50 and adjoins an end of the helical section 68 facing the base part 42.

Figure 3:
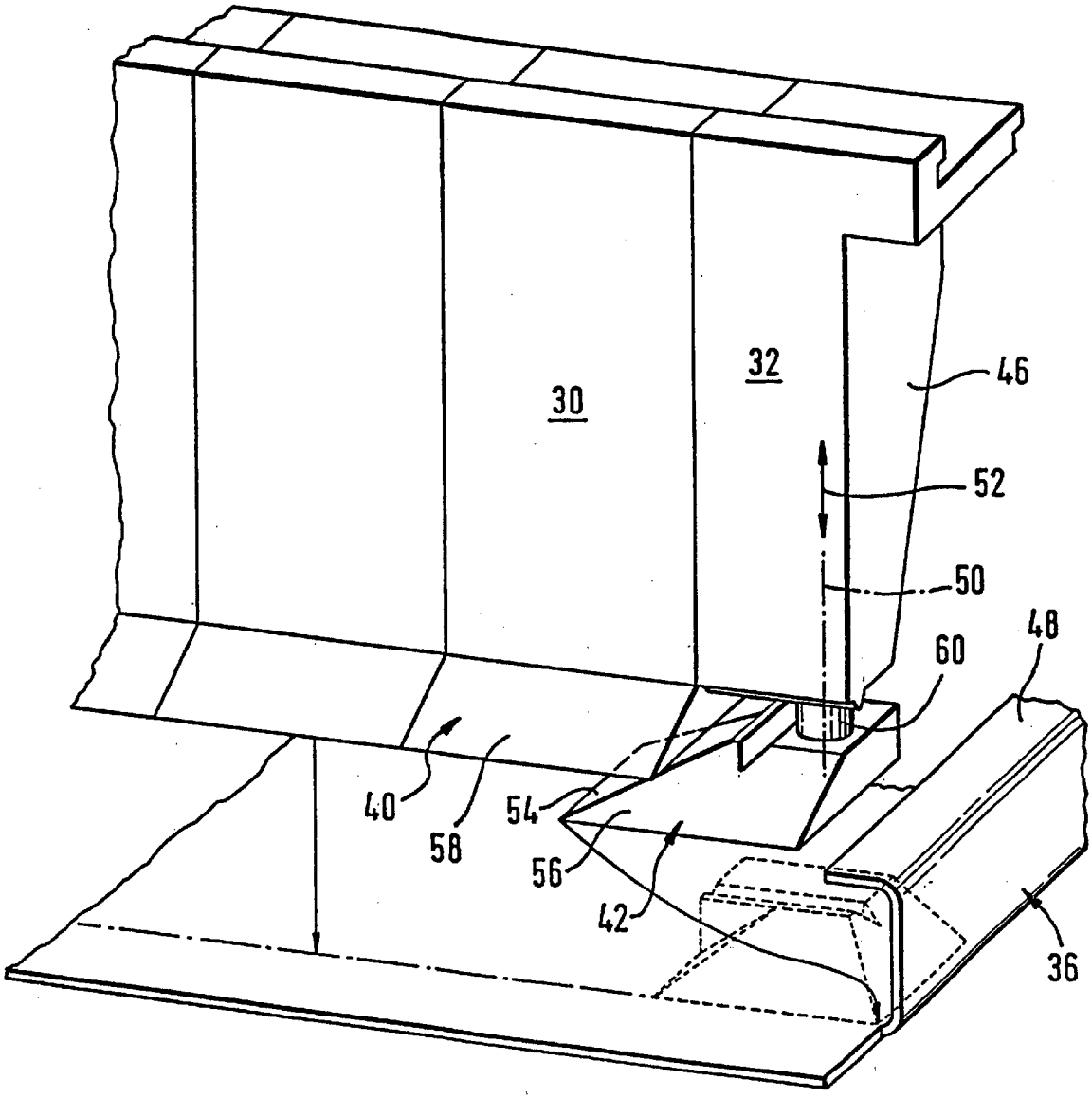
FIG. 3 shows a detail in an enlarged illustration in perspective of a clamping tool segment with a movable base in insertion position (illustrated as solid lines) and in clamping position (illustrated as dashed lines)
Figure 4:
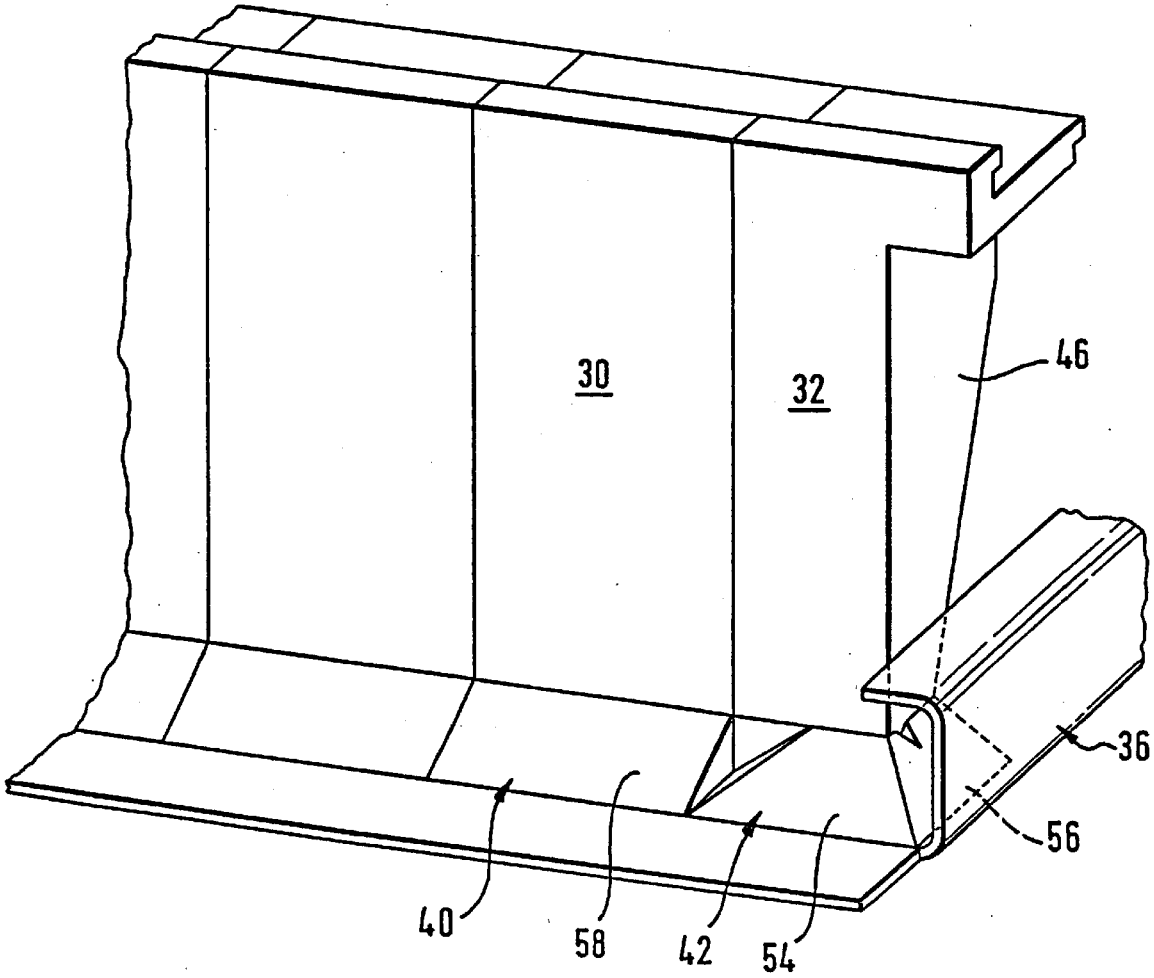
FIG. 4 shows an illustration of the clamping tool segment with a movable base according to FIG. 3 in clamping position during clamping of the sheet-metal part immediately prior to bending.
Figure 5:
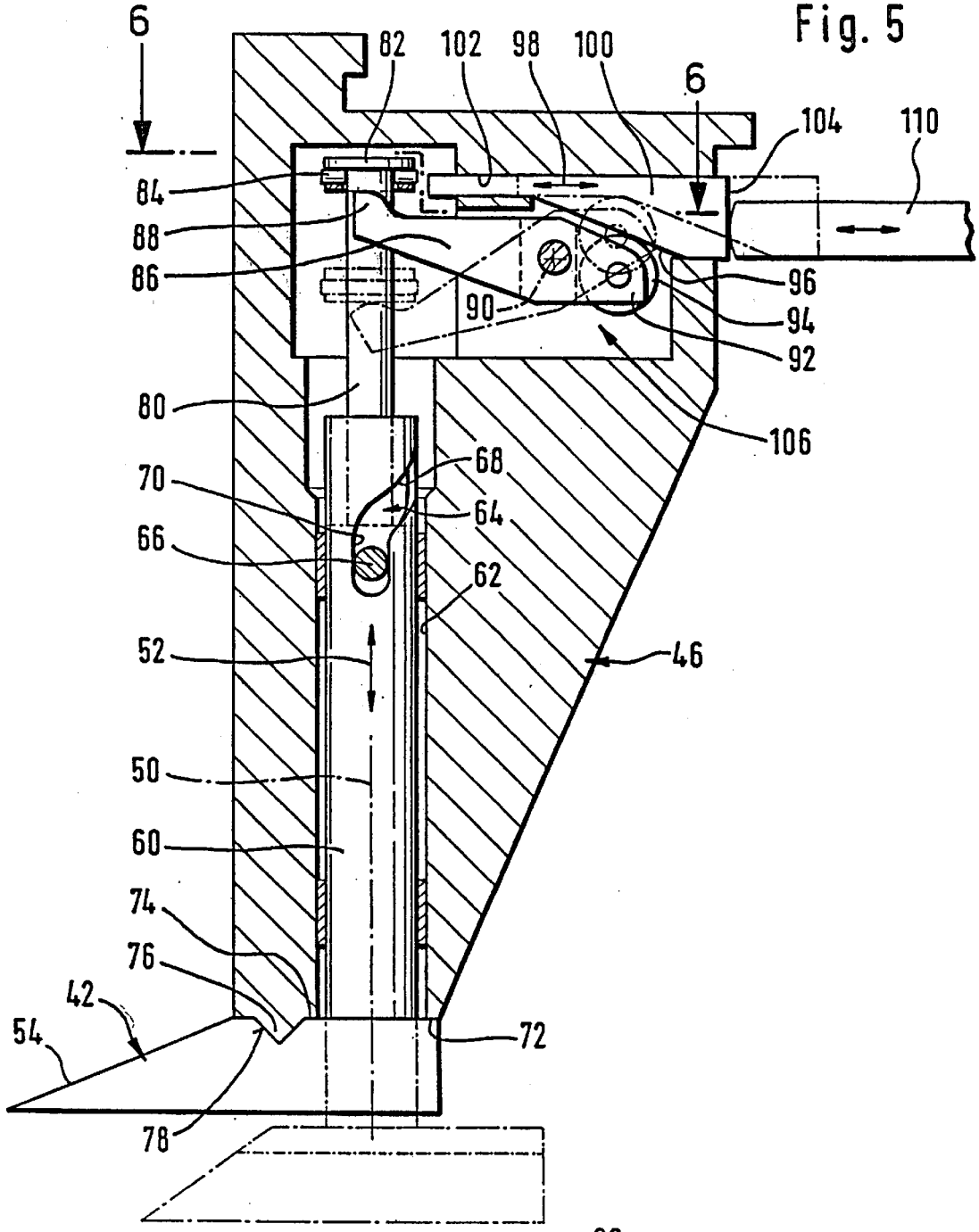
FIG. 5 shows an enlarged illustration of a vertical section in the region C in FIG. 1.
Figure 6:
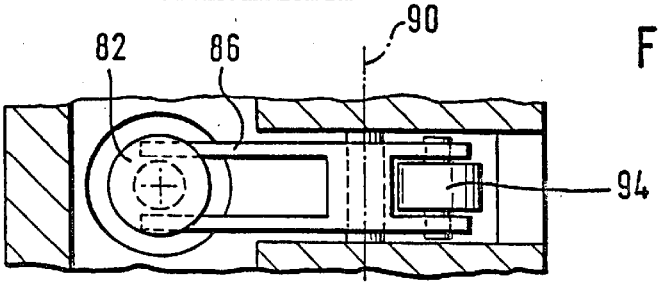
FIG. 6 shows a section along line 6—6 in FIG. 5.

A movement of the shaft 60 in the longitudinal direction 52 leads to the fact that as long as the connecting link follower 66 is moving in the straight section the base part moves away from a lower contact surface 72 of the upper part 46 with its support surface 74 first of all without any rotary movement, from its clamping position abutting on the lower contact surface 72 of the upper part 46 with the support surface 74, and then, when the connecting link follower 66 begins to engage in the helical section 68, carries out a rotary movement combined with a continuation of the linear movement of the support surface 74 away from the lower contact surface 72, and to such an extent until the insertion position illustrated in FIG. 3 is reached, in which the base part 42 is turned through 90° about the movement axis 50 and displaced in longitudinal direction 52 thereof to such an extent that its front region 54 extends under the base part 40 of the next clamping tool segment without any collision.

In order to fix the base part 42 relative to the upper part 46 in the clamping position, the upper part 46 is provided, in addition, with a wedge-shaped projection 76 which engages in a correspondingly shaped wedge-shaped groove 78 in the clamping position, wherein the wedge-shaped projection 76 and the wedge-shaped groove 78 extend over the entire width Bo of the upper part 46.

The wedge-shaped projection 76 and the wedge-shaped groove 78 lead to a non-rotatable fixing of the base part 12 relative to the upper part 46 in the clamping position so that any force acting on the base part 42 in clamping position does not result in any torque acting on the connecting guide link 64 and the connecting link follower 66.

In order to displace the shaft 60, a shaft extension 80 thereof is provided with a flange 82, on which a forked lever 86 acts with its fork ends 88 via an intermediate axial bearing 84. The forked lever 86 is mounted in the upper part 46 for rotation about an axis 90 and bears at its end 92 located opposite the fork ends 88 a roller 94 which, for its part, abuts on an inclined surface 96 of a wedge-shaped member 100 which is displaceable linearly in the direction 98 and, for this purpose, is accommodated in a linear guide means 102 in the upper part 46 and projects out of the upper part 46 with a pressure surface 104.

The wedge-shaped member 100, the forked lever 86, the shaft extension 80 with the flange 82 as well as the shift 60 with the connecting guide link 64 and the path follower 66 form a drive means 106.

This drive means 106 can be activated by an activating device 108 explained in the following.

Figure 7:
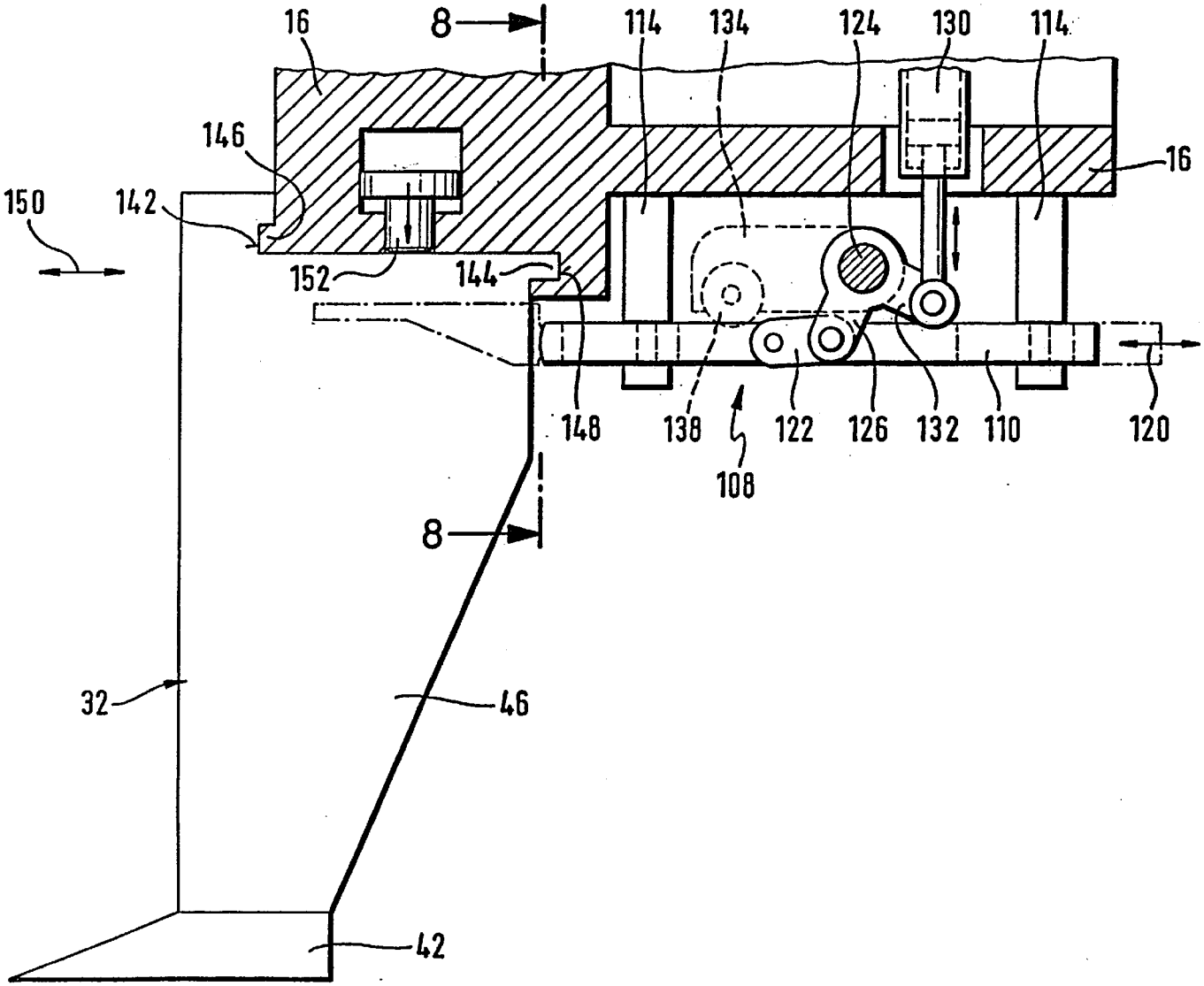
FIG. 7 shows an enlarged illustration of a section in the region C in FIG. 1 with details of an activating device.

The activating device 108 acts on the pressure surface 104 with an actuating slide 110 which, as illustrated in FIG. 7, is mounted on the upper beam 16. For this purpose, as illustrated in FIGS. 7 and 8, stands 114 forming linear guide means for the actuating slide 110 are, for example, provided on a cross bearer 112 of the upper beam 16 and as a result of them the actuating slide 110 can be moved in an actuating direction 120 which preferably extends parallel to the direction 98.

In order to displace the actuating slide 110, a connecting piece 122 is articulatedly connected to it. The connecting piece 122 is, for its part, connected to a lever 126 non-rotatably seated on an actuating shaft 124 so that the actuating slide 110 can be moved in the actuating direction 120 by rotating the actuating shaft 124.

Figure 8:
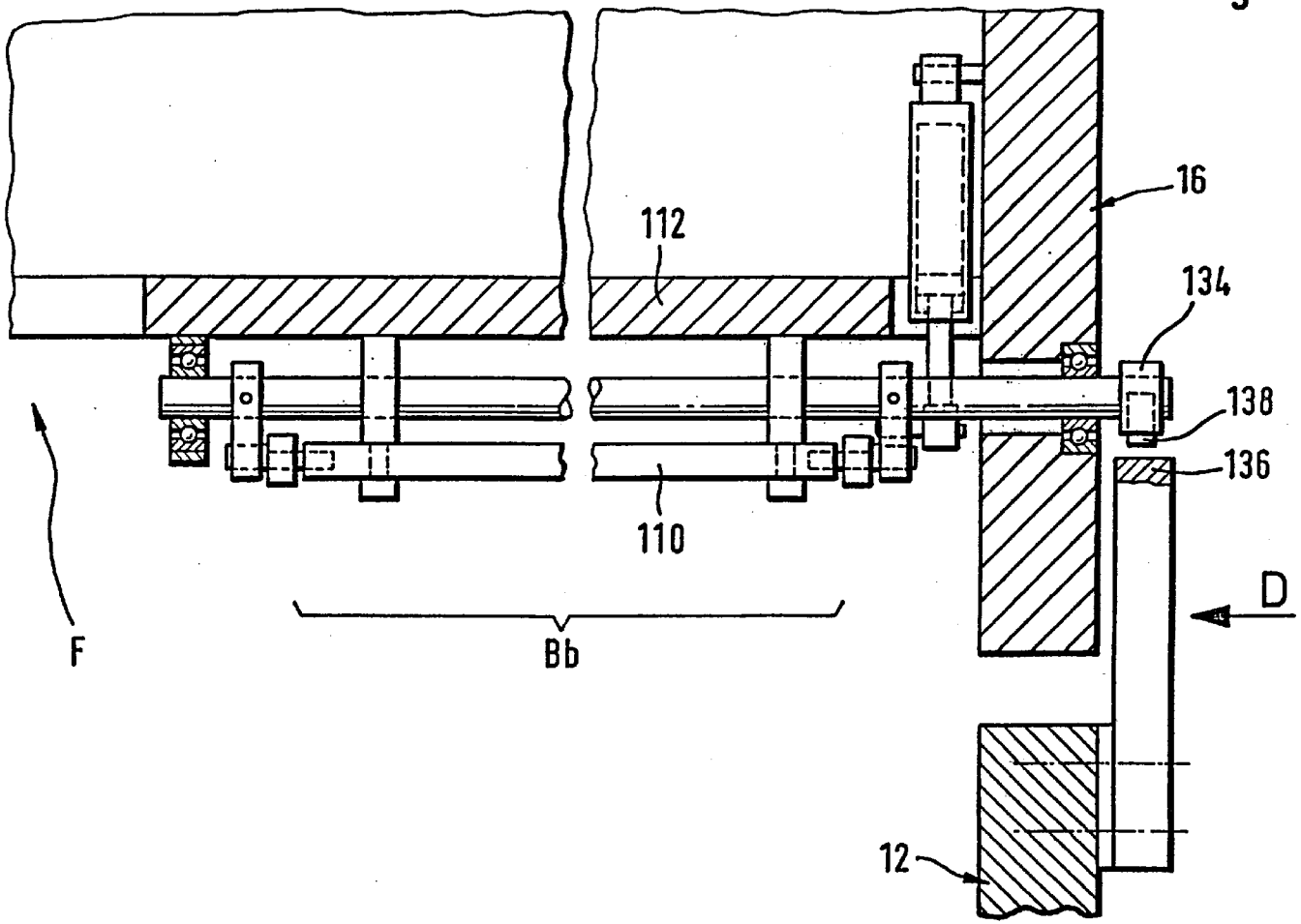
FIG. 8 shows a section along line 8—8 in FIG. 7.
Figure 9:
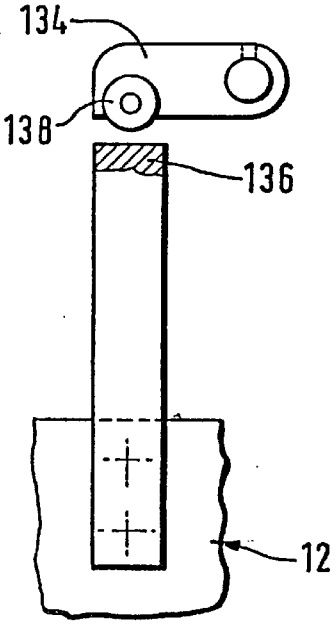
FIG. 9 shows a side view in the direction of arrow D in FIG. 8.

The actuating shaft 124 of the activating device 108 is, on the one hand, rotatable by means of an adjusting drive 130, for example, a compressed air cylinder which acts or, a lever arm 132 rigidly seated on the actuating shaft 124 and, on the other hand, by means of an actuating lever 134 which, as illustrated in FIG. 8, is located to the side of the upper beam 16 and comes to rest on an anvil 136 rigidly connected to the lower beam 12 via a pressure roller 138 during the movement of the upper beam 16 in the direction of the lower beam 12. When the actuating lever is resting on the anvil 136 with the pressure roller 138, an additional movement of the upper beam 16 in the direction of the lower beam 12 leads to a pivoting of the actuating shaft 124 and thus to a displacement of the actuating slide 110 in synchronism with the movement of the upper beam 16 relative to the lower beam 12.

With the adjusting drive 130 it is possible, on the one hand, to displace the actuating slide 110 in the direction of the pressure surface 104 of the wedge-shaped member 100 and thus act on the wedge-shaped member 100 to such an extent that this acts on the flange 82 on the shaft extension 80 via the forked lever 86, causes the base part 42 with the support surface 74 to abut on the lower contact surface 72 of the upper part 46 via the shaft 60 and, consequently, holds the base part 42 in the clamping position. The base part 42 therefore remains in the clamping position irrespective of the movement of the upper beam 16 relative to the lower beam 12.

On the other hand, it is possible as a result of the adjusting drive 130 to move the actuating slide 110 away from the pressure surface 104 of the wedge-shaped member 100 so that the wedge-shaped member 100 does not act on the shaft 60 via the forked lever 86. In this case, the base part 42 will draw the shaft 60 out of the upper part 46 on account of the effect of gravity and thus—caused by the action of the connecting guide link 64 and the connecting link follower 66 already described—carry out a rotation in such a manner that the base part 42 engages with its front region 54 underneath the base part 40 of the next, adjacent clamping tool segment 30. In this position, the base part is in the insertion position, in which it is possible for it to move into a sheet-metal part 36, which is illustrated in FIG. 2 and has a lateral edge region 48 bent twice, for the purpose of clamping.

For such clamping, the base part 42 remains in its insertion position for such a time until the base part 42 is located so low that a collision with the edge region 48 bent twice can no longer take place. This is brought about by corresponding adjustment of the actuating lever 134 such that this does not come to rest on the anvil 136 until the base part 42 is already so low that it can no longer collide with the edge region 48 bent twice with its side region 56.

During movement of the upper beam 16 as far as this position, the base part 42 remains in its insertion positions. During continued movement, a displacement of the actuating slide 110 in the direction of the pressure surface 104 of the wedge-shaped member 100 takes place, triggered by the actuating lever 134 which now counteracts the adjusting drive 130, so that the wedge-shaped member acts on the shaft 60 in the direction of its longitudinal direction 52 via the forked lever 86. With increasing movement of the upper beam 16 in the direction of the lower beam 12, a pivoting movement of the base part 42 takes place in the direction of its clamping position, wherein the base part 42 carries out a linear movement at the same time, and after termination of the pivoting movement in the manner already described only a linear movement takes place, with which the wedge-shaped projection 76 of the upper part 46 comes to engage in the wedge-shaped groove 78 in the base part 42 so that the base part 42 reaches the clamping position shortly prior to any clamping abutment on the sheet-metal part 46 and in this position it is able to apply the forces necessary for clamping the sheet-metal part 36.

All the clamping tool segments 30 and 32 have in the region of their upper parts 44 and 46 an undercut 142 and a projection 144 which can be brought into engagement with a corresponding projection 146 and undercut 148, respectively, of the upper beam. In this respect, the clamping tool segment, 30 and 32 can be inserted into and removed from the upper beam 16 in an insert direction 150. A fixing of the clamping tool segments 30 and 32 in position takes place merely by way of frictional connection, namely by means of a clamping device 152 acting on the respective upper parts 44 or 46 transversely to the insert direction 150 (FIG. 7).

In order to create the possibility in the inventive bending machine of being able to insert workpieces by means of a manipulator handling the workpieces, the actuating slide 110 merely extends over a width Bb of the respective upper beam, wherein as a result of the position of the actuating slide and its width Bb a possible positioning area for a clamping tool segment 32 forming a corner piece is predetermined, within which the respective clamping tool segment 32 can, however, be positioned as required since the actuating slide 110 extending with the width Bb can act on the pressure surface 104 of the wedge-shaped member 100 in any position (FIG. 8).

Such an actuating slide 110 is preferably provided over the respective width Bb in the two outer regions of the upper beam 16 located opposite one another so that a free space F remains therebetween, into which workpieces can be inserted by means of a manipulator.

What is claimed is:

1. A bending machine comprising:

a bending beam, a first and a second clamping beam for clamping a workpiece, one of said clamping beams having clamping tool segments arranged so as to be interchangeable, wherein:

at least one clamping tool segment with a movable base has a base part mounted on an upper part and movable relative thereto from a clamping position into an insertion position and vice versa, a drive means is arranged in the upper part of the clamping tool segment with a movable base for the movement of the base part, the drive means has an energy-receiving element for supplying drive energy during contact with an energy input element of an activating device, and the energy input element is movable relative to the respective clamping beam in a direction towards the energy receiving element of the clamping tool segment with a movable base.

2. A bending machine as defined in claim 1, wherein:

the energy input element defines a positioning area for the clamping tool segment with a movable base, and when the clamping tool segment is arranged within the positioning area, the drive energy is transferable from the energy input element to the energy-receiving element in any optional position relative to one another.

3. A bending machine as defined in claim 2, wherein the positioning area of the clamping tool segment with a movable base merely extends over part of the width of the respective clamping beam.

4. A bending machine as defined in claim 2, wherein a positioning area for a clamping tool segment with a movable base is provided on the clamping beam in respectively opposite outer regions.

5. A bending machine as defined in claim 2, wherein the energy input element extends over the positioning area along the respective clamping beam.

6. A bending machine as defined in claim 1, wherein the energy input element is movable with the respective clamping beam relative to the other clamping beam.

7. A bending machine as defined in claim 1, wherein mechanical drive energy is transferable to the energy-receiving element with the energy input element.

8. A bending machine as defined in claim 7, wherein the energy input element transfers the drive energy by way of pressure on the energy-receiving element.

9. A bending machine as defined in claim 1, wherein:

said activating device is arranged on the bending machine.

10. A bending machine as defined in claim 1, wherein:

said drive means is free from supply lines since the mere contact between the energy-receiving element and the energy input element is sufficient to supply the drive means with the necessary energy for the movement of the base part.

11. A bending machine, comprising:

a bending beam, a first and a second clamping beam for clamping a workpiece, one of said clamping beams having clamping tool segments arranged so as to be interchangeable, wherein:

at least one clamping tool segment with a movable base has a base part mounted on an upper part and movable relative thereto from a clamping position into an insertion position and vice versa, a drive means is arranged in the upper part of the clamping tool segment with a movable base for the movement of the base part, the drive means has an energy-receiving element for supplying drive energy during contact with an energy input element of an activating device, the energy input element actuates the energy-receiving element synchronously to a closure movement of the clamping beams for clamping the workpiece, and the energy input element is actuatable by means of an actuating element detecting any relative movement of the clamping beams.

12. A bending machine, comprising:

a bending beam, a first and a second clamping beam for clamping a workpiece, one of said clamping beams having clamping tool segments arranged so as to be interchangeable, wherein:

at least one clamping tool segment with a movable base has a base part mounted on an upper part and movable relative thereto from a clamping position into an insertion position and vice versa, a drive means is arranged in the upper part of the clamping tool segment with a movable base for the movement of the base part, the drive means has an energy-receiving element for supplying drive energy during contact with an energy input element of an activating device, and an adjusting drive is provided for the energy input element to actuate the energy-receiving element such that the base part is maintained in a clamping position in which the workpiece is clamped between the clamping beams.

13. A bending machine, comprising:

a bending beam, a first and a second clamping beam for clamping a workpiece, one of said clamping beams having clamping tool segments arranged so as to be interchangeable, wherein:

at least one clamping tool segment with a movable base has a base part mounted on an upper part and movable relative thereto from a clamping position into an insertion position and vice versa, a drive means is arranged in the upper part of the clamping tool segment with a movable base for the movement of the base part, the drive means has an energy-receiving element for supplying drive energy during contact with an energy input element of an activating device, and the drive means of the base part moves the base part away from the upper part into a position reaching under a base part of a next clamping tool segment in order to reach the insertion position.

14. A bending machine as defined in claim 13, wherein the drive means moves the base part on a helical path during the transition from the clamping position to the insertion position.

15. A bending machine as defined in claim 14, wherein the base part in the insertion position is pivoted through 90° in relation to the clamping position.

16. A bending machine as defined in claim 13, wherein the drive means initially moves the base part linearly away from the upper part, proceeding from the clamping position.

17. A bending machine as defined in claim 15, wherein the drive means comprises a connecting guide link defining the path of movement of the base part between the clamping position and the insertion position.

18. A bending machine as defined in claim 17, wherein the connecting guide link acts on a shaft bearing the base part.

19. A bending machine as defined in claim 18, wherein an actuation of the energy-receiving element leads to an axial displacement of the shaft.

20. A bending machine as defined in claim 19, wherein the energy-receiving element acts on the shaft via a transmission mechanism.

21. A bending machine, comprising:

a bending beam, a first and a second clamping beam for clamping a workpiece, one of said clamping beams having clamping tool segments arranged so as to be interchangeable, wherein:

at least one clamping tool segment with a movable base has a base part mounted on an upper part and movable relative thereto from a clamping position into an insertion position and vice versa, a drive means is arranged in the upper part of the clamping tool segment with a movable base for the movement of the base part, the drive means has an energy-receiving element for supplying drive energy during contact with an energy input element of an activating device, and form-locking elements engaging in one another in the clamping position and non-rotatably fixing the base part are connected to the upper part and to the base part of the clamping tool segment with the movable base.

22. A bending machine as defined in claim 21, wherein the form-locking elements include a conical fit.

* * * * *